United States Patent [19]

Vuilleumier et al.

[11] Patent Number: 4,611,925

[45] Date of Patent: Sep. 16, 1986

[54] TIMEPIECE WITH CALENDAR

[75] Inventors: Cyril Vuilleumier; Bruno Erni, both of Bienne, Switzerland

[73] Assignee: Omega SA, Switzerland

[21] Appl. No.: 730,128

[22] Filed: May 3, 1985

[30] Foreign Application Priority Data

May 18, 1984 [CH] Switzerland ..... 2447/84

[51] Int. Cl.[4] ..... G04B 19/24

[52] U.S. Cl. ..... 368/28

[58] Field of Search ..... 368/28, 35, 37

[56] References Cited

U.S. PATENT DOCUMENTS 2,591,819 4/1952 Huguenin ..... 368/37

3,152,437 10/1964 Vasseli ..... 368/37

FOREIGN PATENT DOCUMENTS 100231 5/1922 Switzerland .

*Primary Examiner*—Vit W. Miska

*Attorney, Agent, or Firm*—Griffin, Branigan, & Butler

[57] ABSTRACT

The timepiece of the invention includes a hand for date display. This hand is driven via a calendar ring of a well-known type bearing teeth on its outer circumference. Such teeth drive intermediate gearing which in turn drives a calendar wheel fixed to the date display hand. This mechanism enables the mounting of a date displaying hand on a movement normally intended to show dates through a dial opening with minimum modifications.

8 Claims, 2 Drawing Figures

TIMEPIECE WITH CALENDAR

The present invention concerns a calendar timepiece comprising a calendar ring arranged to be stepwise driven once per day by means of a mechanism controlled by the timepiece drive motor.

BACKGROUND OF THE INVENTION

Timepiece of this type are known in the prior art. The days of the month 1 to 31 are inscribed on the calendar ring and appear one after the other through an opening cut in the dial. Numerous and varied means have been conceived for driving this ring from the timepiece drive motor. A known type of arrangement will appear in the text of the present description.

In antique watches or in specially constructed timepieces the date does not appear in the form of numbers through an opening but is displayed by means of a hand which is displaced over a dial on which are placed the indications relative to the date. This hand is either coaxial with the hands indicating hours and minutes or displaced from the center of the watch to sweep a small dial graduated according to the date.

An example of this second type of arrangement is described in the Swiss Pat. No. 100 231 where the cannon wheel bears a flexible finger which drives a gear arrangement through one tooth space at each revolution of the cannon wheel which rotates once every twelve hours. The gear arrangement meshes in turn with a calendar wheel which makes one revolution in 24 hours. The date hand is solidly mounted on the calendar wheel by means of a cannon tube. The setting of the date hand is obtained by acting directly on the calendar wheel.

It will be understood that such a mechanism is not adapted to modern watches having a greatly reduced thickness in which it is desired to arrange a date display by means of a hand as dictated by certain current fashions. Above all, such a mechanism requires the reconsideration of the entire construction of known movements which comprise for the most part calendars with a dial opening and which exhibit such greatly reduced thickness.

SUMMARY OF THE INVENTION

The principal purpose of the invention is to provide a timepiece equipped with a date displaying hand and employing a movement originally intended to be provided with a dial opening type calendar. Thus the calendar mechanism according to the invention may be applied to watch movements of modern construction without necessitating any major modifications. Such date displaying hand accordingly is controlled by means of the calendar ring found in such existing timepiece calibers.

DESCRIPTION OF THE PREFERRED EMBODIMENT

Figure 1:
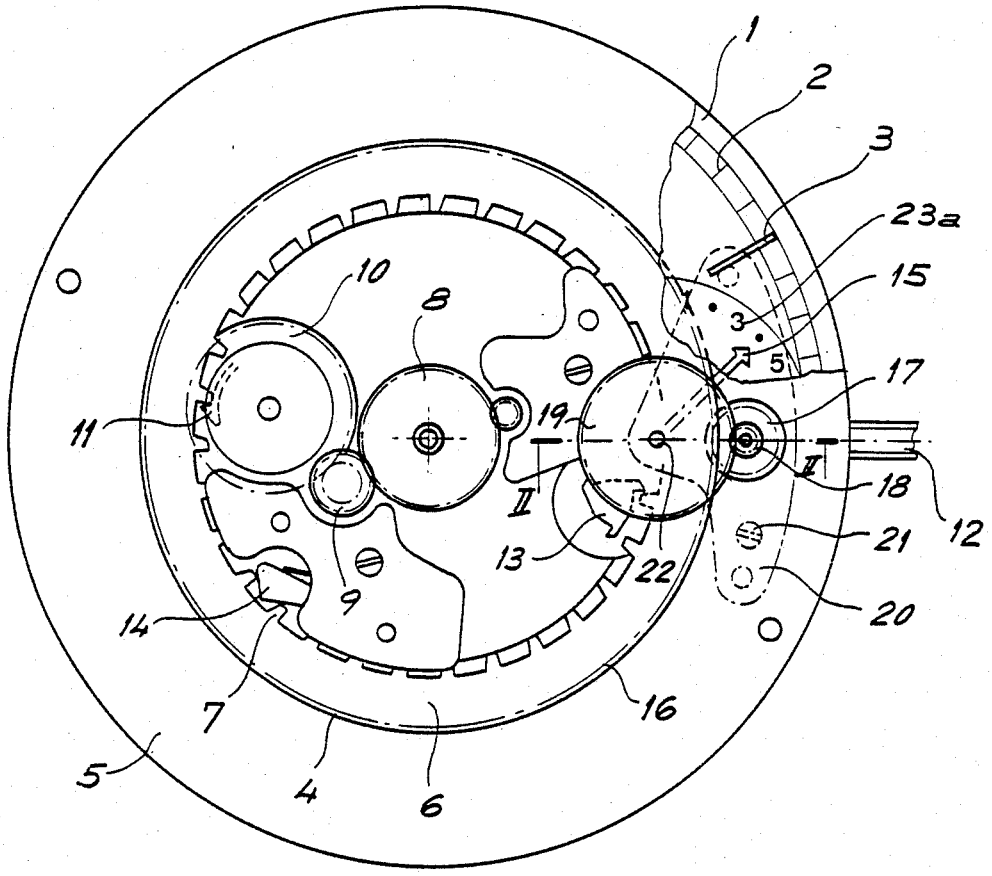
FIG. 1 is a plan view of the timepiece according to the invention in which the dial and dial support have been removed for the most part.

The movement shown on FIG. 1 has been freed of its dial base and of most of its dial 1 which appears only partially and on which are placed the indices of minutes 2 and hours 3. A channel 4 cut into the base plate 5 serves as a guide for a calendar ring 6 which is rotatively mounted and is coaxial to the center of the movement. The calendar ring 6 is provided with internal teeth comprising thirty-one teeth 7, i.e. one tooth per day of the month. The ring advances by steps, one per twenty-four hours at midnight. It receives its rotational movement via a gear train comprised of the hour wheel 8 making one revolution in twelve hours, an intermediate calendar wheel 9 and a calendar wheel 10 making one revolution in twenty-four hours. A spring loaded hook 11 connected to wheel 10 causes the ring 6 to advance through a step once each day when the hook 11 engages with a tooth of the ring. The hour wheel 8 is normally driven by the motor mechanism of the watch. The movement further comprises a setting mechanism for the calendar ring 6 controlled by stem 12 of which there is shown only a portion with three teeth 13. Finally, the jumper 14 enables precise positioning of ring 6 between steps.

The mechanism which has just been described is well known to the art. In watches in which the date appears through a dial opening ring 6 the ring further bears date indications disposed proximate its periphery. In such case the width of the ring is greater than that which appears on the figure in a manner to provide sufficient space for placing thereon the inscribed digits.

The timepiece according to the invention bears a hand 15 for date display which is controlled by the calendar ring 6. According to the preferred embodiment of the invention, ring 6 bears outer teeth 16 and coupling means 17, 18 and 19 for coupling the date hand 15 to teeth 16.

Figure 2:
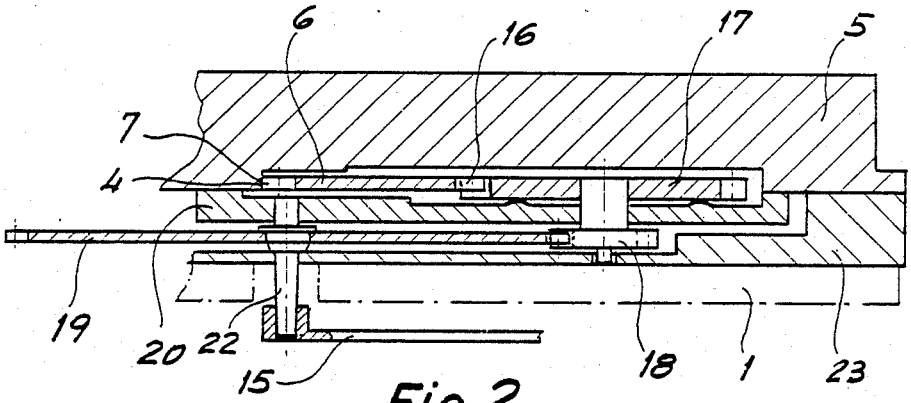
FIG. 2 is a cross-section at an enlarged scale along line II—II of FIG. 1.

As is particularly apparent on FIG. 2, these coupling means comprise a reduction gear 17 meshing with teeth 16, a reduction pinion 18 fixed to gear 17 and a calendar wheel 19 which meshes with pinion 18. Thus when ring 6 advances through a step, hand 15 likewise advances through a step in the same sense. FIG. 2 further shows that the gear arrangement formed by gear 17 and pinion 18 is pivotally mounted on a calendar bridge 20, fixed onto base plate 5 by means of screw 21, as seen on FIG. 1. FIG. 2 likewise shows that the date wheel 19 is force fitted onto an axle 22 which is pivotally mounted at the same time in the calendar bridge 20 and in the dial support 23. The axle 22 bears the date hand 15. The date references 23$^a$ appear on the dial 1 of the watch (see FIG. 1).

Thus the construction which has just been described employs a classic date display mechanism using a calendar ring to drive a date hand with very few modifications and above all maintains the very small thickness of the original movement. Effectively, the driving mechanisms of the ring, its positioning and its setting are employed in the same manner for driving, positioning and setting the date hand.

It will be noted that hand 15 could be replaced by a disc (not shown) on which would be inscribed a reference marker forming the equivalent of a hand this being displaced relative to indicia borne by dial 1. Such disc could also be contained in an opening pierced in the dial for further reducing the thickness.

What we claim is:

1. In a calendar timepiece having a calendar ring arranged to be stepwise driven once per day by a mechanism controlled by the timepiece motor and a hand for displaying the date, the improvement comprising means driven by said calendar ring for driving said hand.

2. The improvement as claimed in claim 1 wherein said calendar ring bears external teeth and said means comprises coupling means engaged with said teeth and connected to the date displaying hand.

3. A calendar timepiece as set forth in claim 2 wherein said coupling means comprise a reduction gear engaging said teeth and a reduction pinion coaxial with and fixed to said reduction gear, said reduction pinion meshing with a calendar gear on which is mounted a shaft bearing the date displaying hand.

4. A calendar timepiece as set forth in claim 1 wherein the date displaying hand comprises a reference marker applied to a disc.

5. In a calendar timepiece having a timepiece drive means for rotating a calendar ring about an axis which is located at the center of the watch dial, the improvement comprising a hand for displaying the date, means supporting said hand for rotation about an axis which is offset with respect to the center of said dial, and connecting means connecting said hand to said calendar ring so that said hand is driven by said calendar ring.

6. The improvement as claimed in claim 5 wherein said calendar ring bears external teeth and said connecting means comprises coupling means engaged with said teeth and connected to the date displaying hand.

7. A calendar timepiece as set forth in claim 6 wherein said coupling means comprise a reduction gear engaging said teeth and a reduction pinion coaxial with and fixed to said reduction gear, said reduction pinion meshing with a calendar gear on which is mounted a shaft bearing the date displaying hand.

8. A calendar timepiece as set forth in claim 7 wherein the date displaying hand comprises a reference marker applied to a disc.

* * * * *